United States Patent [19]

Fastner et al.

[11] 4,015,655

[45] Apr. 5, 1977

[54] PROCESS AND APPARATUS FOR CONTINUOUSLY CASTING STRANDS OF UNKILLED OR SEMI-KILLED STEEL

[75] Inventors: Thorwald Fastner; Max Mayrhofer; Ernst Bachner, all of Linz, Austria

[73] Assignee: Vereinigte Osterreichische Eisen- und Stahlwerke-Alpine Montan Aktiengesellschaft, Linz, Austria

[22] Filed: June 20, 1975

[21] Appl. No.: 588,817

[30] Foreign Application Priority Data

June 25, 1974 Austria ..... 5236/74

[52] U.S. Cl. ..... 164/66; 164/82; 164/259; 164/281 R

[51] Int. Cl.[2] ..... B22D 21/02; B22D 11/00; B22D 27/00; B22D 11/10

[58] Field of Search ..... 164/66, 82, 133, 281, 164/259, 337, 306, 305, 309

[56] References Cited

UNITED STATES PATENTS

| | | | |
|---|---|---|---|
| 3,017,676 | 1/1962 | Ewen | 164/259 |
| 3,517,726 | 6/1970 | Mills et al. | 164/82 |
| 3,746,070 | 7/1973 | Hill | 164/82 |
| 3,833,047 | 9/1974 | Tovini | 164/82 |
| 3,867,978 | 2/1975 | Johansson et al. | 164/82 |
| 3,884,290 | 5/1975 | McCubbin | 164/82 |
| 3,888,294 | 6/1975 | Fastner et al. | 164/66 |
| R27,447 | 8/1972 | Richards | 164/82 |

*Primary Examiner*—Harrison L. Hinson
*Attorney, Agent, or Firm*—Brumbaugh, Graves, Donohue & Raymond

[57] ABSTRACT

A process and an apparatus for continuously casting strands of unkilled or semi-killed steel having a product of [%C] × [%O] that is less than 0.002, preferably less than 0.0015 due to deoxidizing prior to casting, a carbon content of between 0.02 and 0.20%, an Al content not exceeding 0.01% and a Si content not exceeding 0.05%, wherein the steel is cast from a tundish through a casting tube that is immersed in the mould and flush gas is introduced into the casting tube and moved on together with the steel which leaves said casting tube via two lateral, upwardly inclined openings. The ascending gas bubbles are deflected by means of a guiding plate and move through a gap formed between said guiding plate and the walls of said mould, flushing out CO-bubbles forming at the front of solidification and thus providing for an edge zone that is free from blow-holes.

7 Claims, 2 Drawing Figures

PROCESS AND APPARATUS FOR CONTINUOUSLY CASTING STRANDS OF UNKILLED OR SEMI-KILLED STEEL

BACKGROUND OF THE INVENTION

The invention relates to a process for continuously casting unkilled or semi-killed steel with a carbon content of about 0.02 to 0.20%, wherein the steel is cast from a tundish through a casting tube which is immersed in a water-cooled mould, and the solidifying strand is extracted from the mould and further cooled.

There are various purposes for which unkilled steel is the most suited and cannot be replaced by killed steel. Such fields of application are, for instance, zinc coating, enamelling and autogenous welding. But even when a completely faultless surface is needed, unkilled steel is preferred.

Hitherto it has not been possible to cast unkilled steel to qualitatively faultless strands on a large scale. The intensive CO-formation at the front of solidication which is necessary for obtaining an edge zone free from blow-holes, leads to a boiling-over of the steel in the mould. Thus, so far it has not been possible to utilize the great economic advantage of continuous casting for unkilled steel.

Semi-killed steel, too, for qualitative reasons cannot be continuously cast, because here too, it has not been possible to obtain an edge zone free from blow-holes at contents of deoxidation products that are as low as possible. The gas bubbles formed during casting are enclosed by the solidifying strand skin and some of them reach the surface of the cast product. The bubbles rupture during rolling, the cavities oxidize and irreparable faults form at the surface of the rolling stock. Only when one succeeds in obtaining a surface that is free from blow-holes, i.e. when the distance of the gas bubbles from the surface is at least 5 mm, can a faultless surface of the rolling stock be achieved.

In the prior art a number of suggestions have been made for continuously casting unkilled steel. Thus, according to U.S. Pat. No. 3,189,956, prior to casting the steel is first deoxidized and then subsequently oxidized by blowing oxygen onto the freely falling casting stream in order to achieve a controlled boiling. However the certainty of yielding a certain product [%C] × [%O] in the desired range of 0.0040 to 0.0045% is very low with this process. Also, there is the danger of over-boiling and the inclusion content of such steels is increased due to reoxidation. The freely falling casting stream furthermore increases the danger of break-throughs and causes a poor surface.

USSR Patent No. 1,346,029 indicates that strands of unkilled steel can be produced by introducing inert gas into the tundish and into the mould, the gas nozzles being immersed in the melt in the mould. With this process, however, it is not possible to avoid the precipitation of gas bubbles in the edge zone of the cast product, because it is not possible to supply an amount of inert gas sufficient to flush out the carbon monoxide bubbles without an over-boiling of the melt. Furthermore, in this process casting disturbances may occur due to the formation of big bubbles.

SUMMARY OF THE INVENTION

The invention aims at preventing the above described disadvantages and difficulties and has as its object the casting of unkilled or semi-killed steel with a blow-hole-free edge zone in the strand of at least 5 mm thickness, wherein operational difficulties due to over-boiling and the like cannot occur and only a limited amount of apparatus is necessary.

According to the invention, in a process of the above defined kind, this object achieved in that the composition of the steel, prior to casting is adjusted by deoxidation to a value of the product [%C] × [%O] of below 0.002, preferably below 0.0015, the Al content (soluble) does not exceed 0.01%, the Si content does not exceed 0.05% in the steel, and during casting flush gas is introduced into the casting tube and the gas bubbles emerging from the casting tube are deflected towards the walls of the mould. This combined procedure of deoxidizing/flushing is based on the finding that the reduction of the product [%C] × [%O] to below 0.002 itself reduces the amount of gas bubbles ascending in the mould to such an extent that by intensively supplying inert gas to the front of solidification the CO-bubbles forming there can be flushed out, so that the edge zone really becomes free from blow-holes and casting disturbances due to over-boiling do not occur.

Advantageously, a horizontal guiding plate is used for deflecting the gas bubbles, which guiding plate fills the greatest part of the interior of the mould, so that the gas bubbles ascend evenly distributed at the strand skin along the front of solidification.

Suitably, the gas bubbles are allowed to ascend along the strand skin from a depth in the mould at which the thickness of the strand skin is at least 5 mm. Any inert gas can be used as a flush gas, but preferably argon is used. The amount to be used advantageously can be between 5 and 20 Nl/min, in order to control the process on the one hand, and to prevent an undesirably strong movement of the bath on the other hand.

The invention also comprises an apparatus for carrying out the described process with a mould, into which a casting tube is immersed to below the level of the bath. The casting tube has outlet openings for the steel at its lower end and an inlet opening for inert flush gas at its upper part. This apparatus according to the invention is characterized in that in the mould, slightly above the outlet openings, a horizontal plate surrounding the casting tube is mounted. The lateral edges of the plate extend at a distance of 10 to 40 mm along the wall of the mould, so that the gas bubbles leaving the outlets of the casting tube are flushed to the lower side of the guide plate.

Suitably, the casting tube can have a closed bottom and upwardly inclined lateral outlets.

Furthermore, the horizontal plate can be mounted on vertical carriers which are held above the mould.

The process of the invention is independent of the Mn content of the steel. This usually can be between 0.25 and 0.50%. Also the casting temperature is not critical. The deoxidation can be carried out with the usual deoxidizing agents, in particular with aluminum or silicon. Also a flush gas treatment can be carried out in the melting vessel, in the ladle or in the tundish, or a degassing by means of a vacuum treatment can be carried out in order to achieve the desired product of [%C] × [%O].

BRIEF DESCRIPTION OF THE DRAWINGS

The principle of the process of the invention and the apparatus for carrying out the method shall now be described in greater detail with reference to the drawing, wherein.

DESCRIPTION OF A PREFERRED EMBODIMENT

Figure 1:
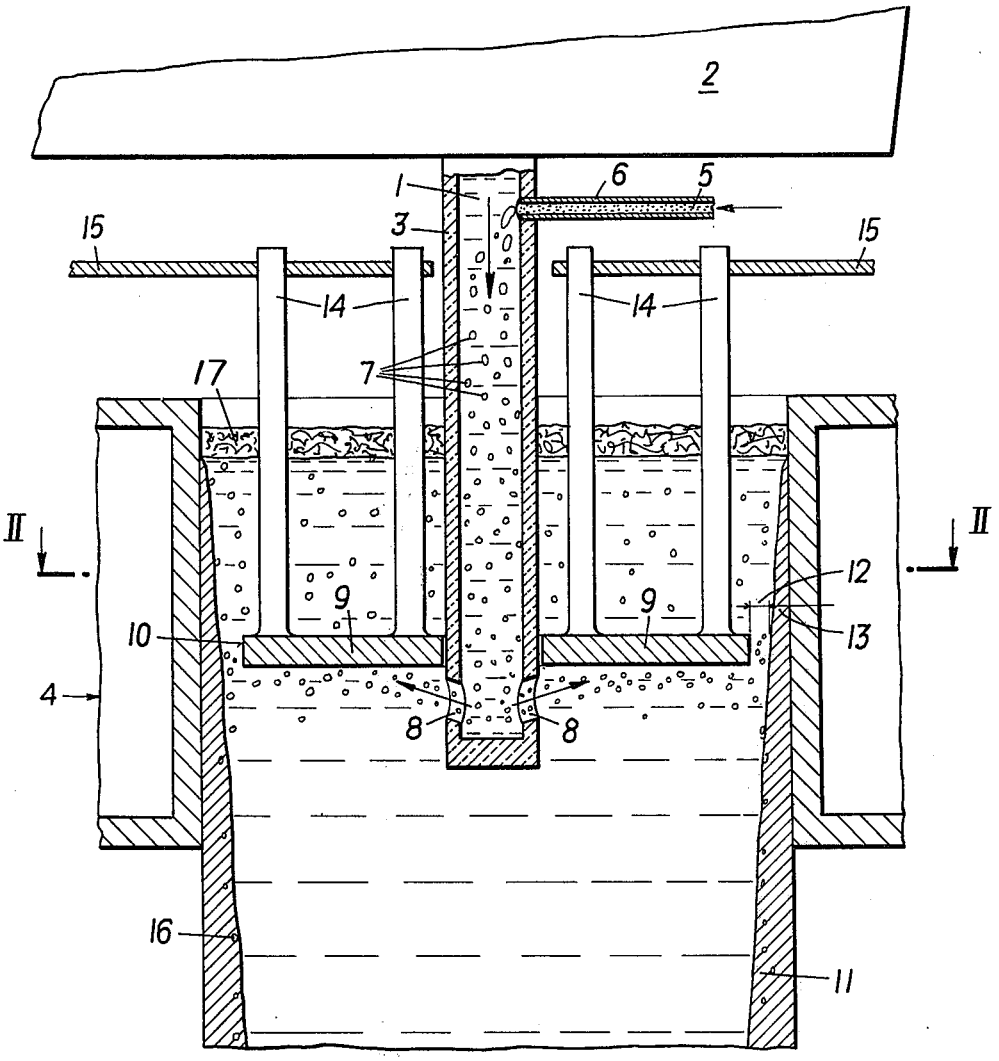
FIG. 1 is a vertical section of a mould.
Figure 2:
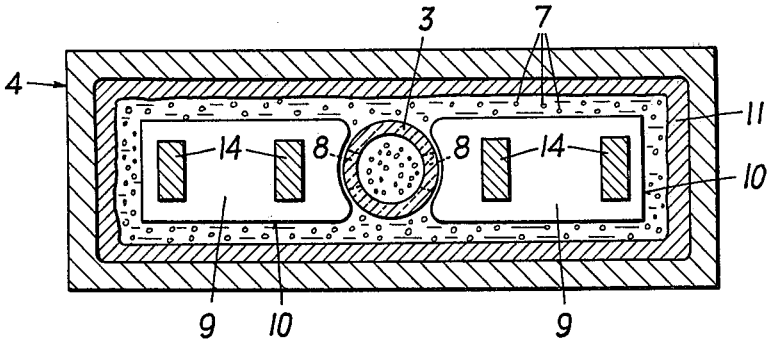
FIG. 2 is a horizontal section along line II—II.

Pre-deoxidized steel 1 flows from a tundish 2 through a casting tube 3 into the mould 4. Inert gas 5 is introduced into the casting tube through a lateral conduit 6 and is carried into the mould by the inflowing steel. When the inert gas passes through the casting tube many small bubbles 7 form. Together with the steel they enter the mould via lateral outlets 8 whose axes are upwardly inclined. Slightly above the outlets 8 a horizontal guiding-or controlling plate 9 is arranged. This plate surrounds the casting tube and its edges 10 follow the contour of the mould-walls at a distance 12. The guiding plate prevents the bubbles from ascending immediately after their leaving the outlets 8; it guides the bubbles 7 into the gap between the edges 10 of the plate 9 and the strand skin 11. This gap is denoted with 12. The inert gas bubbles ascend along the front of solidification, taking with them to the surface the CO-bubbles forming at the front of solidification. Thus they prevent CO-bubbles from being enclosed by the solidifying strand skin. In order for the inert gas bubbles 7 to get into good contact with the front of solidification, the width of the gap 12 of the lower edge 10 of the guiding plate to the strand skin is chosen to be in range between 10 and 40 mm. When the distance is smaller, there is the danger of "growing-together", when the distance is larger, the optimal effect would no longer be present. The thickness 13 of the strand skin in this place must be at least 5 mm, i.e. when choosing the depth at which the guiding plate is mounted, one must take into consideration this thickness of at least 5 mm. When the edge zone that is free from blow-holes is desired to be thicker than 5 mm, a longer casting tube has to be utilized and the guiding plate has to be arranged accordingly lower.

The guiding plate 9 is secured on vertical carriers 14 which in turn are suspended from the linkage 15 above the mould. In the production of slabs it is suitable to provide a number of such casting tubes and guiding plates next to one another in the mould. At a greater distance below the guiding or controlling plates where the inert flush gas is no longer effective, the forming CO-bubbles 16 are enclosed by the solidifying strand skin. These, however, are no longer detrimental, if the surface zone that is free from blow-holes already has a thickness of 5 mm or more. A slag or casting powder layer 17 covers the level of the bath in the mould.

The process of the invention shall be described in greater detail by means of the following example:

Low-carbon unalloyed steel was made molten in a 50 metric ton oxygen converter. The steel was cast into a ladle. The C content immediately before tapping was 0.06%. The steel was deoxidized by the addition of Al-ingots into the casting stream. The amount of Al added was 0.7 kg per metric ton which amount suffices for obtaining a [%C] × [%O]-product that is below 0.002 with not more than 0.010% Al (dissolved) in the casting stream. For control purposes one sample each was taken from the converter immediately prior to tapping and from the ladle after deoxidizing and the oxygen content was determined. After the casting of the steel in the continuous casting plant the oxygen contents were determined. The first sample contained 0.06% oxygen. The oxygen content of the second sample was 0.02%. Therefore, the product of [%C] × [%O] was 0.0012. The steel was led via a tundish into the continuous casting mould. The casting analysis (casting stream sample) yielded the following results:

| C | Mn | P | S | Al | |
|---|---|---|---|---|---|
| 0.06 | 0.30 | 0.015 | 0.018 | 0.005 | % |

The steel was cast in a continuous casting plant, wherein the mould had a cross-section of 1200 × 225 mm. The strand was lowered at a rate of 0.7 m per minute. At the start of casting the flush gas argon, necessary for the process, was introduced into the casting tube through a laterally arranged bore. The flush gas amount was 15 Nl/min. The casting temperature, taken in the tundish, was at 1540° C. The immersion tube had two upwardly inclined outlets directed toward the endwalls (i.e. the narrower walls) of the mould and it was extended into the mould to such a depth that the distance between the upper edge of the outlet openings and the casting level was 300 mm. Shortly after the start of casting, when the predetermined height of the casting level had been reached, horizontal guiding or controlling plates as described above were placed on both sides of the casting tube and were immersed 250 mm deep — relative to the lower edge of the plate — below the surface of the molten steel. The plates had dimensions of 155 × 500 × 30 mm and were preheated. When the plate dimensions and the immersion thickness were chosen, they were based on a strand skin thickness of 15 mm at a depth of 250 mm — this thickness should have the edge zone that is free from blowholes — and a gap width of 12 to 20 mm. Casting powder was continuously put on the molten steel in the mould.

The cross-section of the resulting cast product had an edge zone of 15 mm thickness that was free from blowholes. In the remaining part of the cross-section individual CO-bubbles were present. The piece analysis yielded essentially the same results as the casting analysis. The N content was 0.0025%. The Al-(soluble)-values were at 0.002 to 0.004% somewhat below those of the casting analysis. The quality of the cast product was faultless. The slabs were processed to cold-rolled sheets and their zincing behaviour showed no difference from that of unkilled steel.

What we claim is:

1. In a process for continuously casting strands of unkilled or semi-killed steel of a certain composition with a carbon content between 0.02 and 0.20%, wherein the steel is cast from a tundish through a casting tube extending into a water-cooled mould, a strand skin and a front of solidification forming in the mould cavity adjacent the mould walls and wherein the solidifying strand is extracted from said mould and further cooled, the improvements comprising the steps of:

adjusting the composition of said steel, prior to casting by deoxidation, to a value [%C] × [%O] of below 0.002, the steel having a content of soluble Al not exceeding 0.01% and a Si content not exceeding 0.05%;

introducing flush gas into said casting tube during casting, thereby forming gas bubbles; and deflecting said gas bubbles emerging from said casting tube toward the mould walls by means of a horizontal guiding plate having a cross-section somewhat smaller than the cross-section of the mould cavity to cause said gas bubbles to ascend evenly distributed at said strand skin along said front of solidification.

2. A process as set forth in claim 1, wherein the value [%C] × [%O] is below 0.0015.

3. A process as set forth in claim 1, wherein said gas bubbles are allowed to ascend along the strand skin from a depth in said mould in which said strand skin is at least 5 mm thick.

4. A process as set forth in claim 1, wherein an amount of flush gas of between 5 and 20 Nl/min is used.

5. An apparatus for continuously casting strands of unkilled or semi-killed steel having a carbon content of about between 0.02 and 0.20% comprising:

a tundish;

a water-cooled mould arranged below said tundish;

a casting tube with its lower end extending into said mould below the level of molten steel therein and having outlet steel openings at its lower end and an inlet opening for inert flush gas at its upper end; and a horizontal guiding plate surrounding said casting tube and being arranged in said mould slightly above said outlet openings of said casting tube, said horizontal guiding plate having lateral edges extending along the walls of said mould at a distance therefrom of between 10 and 40 mm, so that gas bubbles emerging from said outlets of said casting tube are flushed to the lower side of said horizontal guiding plate.

6. An apparatus as set forth in claim 5, wherein said casting tube has a closed bottom and said outlets are lateral and upwardly inclined.

7. An apparatus as set forth in claim 5, further comprising vertical carriers for said horizontal guiding plate and means for holding said vertical carriers, said means for holding being arranged above said mould.

* * * * *